US007143905B2

(12) United States Patent
Enayati et al.

(10) Patent No.: US 7,143,905 B2
(45) Date of Patent: Dec. 5, 2006

(54) ENCLOSURE FOR REFUSE AND RECYCLABLE CONTAINERS

(75) Inventors: Shahin Enayati, San Diego, CA (US); Piraphakar Mahalingam, San Diego, CA (US); John C. Wencel, San Diego, CA (US)

(73) Assignee: Chakra Properties, LLC, San Diego, CA (US)

( * ) Notice: Subject to any disclaimer, the term of this patent is extended or adjusted under 35 U.S.C. 154(b) by 88 days.

(21) Appl. No.: 10/858,349

(22) Filed: Jun. 1, 2004

(65) Prior Publication Data

US 2005/0274723 A1 Dec. 15, 2005

(51) Int. Cl.
*B65D 21/02* (2006.01)

(52) U.S. Cl. ..... 220/23.88; 220/23.86; 220/909

(58) Field of Classification Search ..... 220/23.86, 220/23.88, 908, 909
See application file for complete search history.

(56) References Cited

U.S. PATENT DOCUMENTS

| | | | | |
|---|---|---|---|---|
| 1,816,947 | A * | 8/1931 | Kavanagh | 40/567 |
| 3,647,102 | A | 3/1972 | Cooley | |
| 3,803,738 | A * | 4/1974 | Weiss | 40/306 |
| 3,861,767 | A | 1/1975 | Mead | |
| 3,947,985 | A | 4/1976 | Skryzpczak | |
| 5,082,132 | A | 1/1992 | Tsai | |
| 5,174,468 | A * | 12/1992 | Holderman | 220/571 |
| D349,380 | S | 8/1994 | Maturino | |
| 5,402,872 | A | 4/1995 | Clurman | |
| 5,839,590 | A | 11/1998 | Weiner | |
| 5,887,696 | A | 3/1999 | Goetz | |
| 5,908,132 | A | 6/1999 | Pigeon | |
| 5,918,721 | A | 7/1999 | Weinberger | |
| 6,076,694 | A | 6/2000 | Ragot | |
| D428,229 | S | 7/2000 | Olivetti | |
| 6,138,558 | A * | 10/2000 | Harrington | 100/102 |
| 6,193,091 | B1 * | 2/2001 | Olivetti | 220/23.88 |
| D442,995 | S | 5/2001 | Niiyama | |

FOREIGN PATENT DOCUMENTS

| | | |
|---|---|---|
| EP | 0660294 | 6/1995 |

* cited by examiner

*Primary Examiner*—Nathan J. Newhouse
*Assistant Examiner*—Harry Grosso
(74) *Attorney, Agent, or Firm*—Stephen C. Beuerle; Procopio Cory Hargreaves & Savitch LLP

(57) ABSTRACT

An enclosure for a refuse container and a recyclable container includes a frame; a front and a rear carried by the frame and including an advertising holder, a refuse opening, and a recyclable opening, the refuse opening receiving refuse therethrough for depositing the refuse in the enclosed refuse container, the recyclable opening receiving recyclables therethrough for depositing the recyclables in the enclosed recyclable container; a rear carried by the frame and including an advertising holder for holding advertising; a left side carried by the frame and including an advertising holder for holding advertising; a right side carried by the frame and including an advertising holder for holding advertising thereon; and a roof carried by the frame.

17 Claims, 4 Drawing Sheets

ENCLOSURE FOR REFUSE AND RECYCLABLE CONTAINERS

FIELD OF THE INVENTION

The present invention is in the field of trash and recycling receptacles.

BACKGROUND OF THE INVENTION

Recycling is vital to the United States and the global community now more than ever as the amount of waste generated is continually increasing at the same time as the world population continually increases. According to the United States Environmental Protection Agency (EPA), U.S. per capita municipal sold waste production has increased from 2.7 pounds per person per day in 1960 to 4.4 pounds per person per day in 1997.

The EPA considers recycling to be a great success story. Recycling diverted 64 million tons of material away from landfills and incinerators in 1999, up from 34 million tons in 1990. Recycling provides many social and environmental benefits. Recycling reduces air and water pollution associated with land filling and incineration. Valuable energy and natural resources are saved by decreasing the need for virgin materials. In addition, there is a reduction of greenhouse gases that contribute to global climate change. Overall, recycling helps sustain the environment for future generations, and empowers society when they are able to keep their cities clean and progress proactively on behalf of the environment.

In the U.S., recycling of materials like glass, plastic, aluminum and paper products, grew from 9.6% in 1980 to 28.2% in 1998. The agency has set a national recycling goal for 35% by the year 2005. The Integrated Waste Management Act requires governments to prepare and implement plans to reduce 50% of each states' solid waste from landfills by Jan. 4, 2004. A problem with this recycling effort is that most cities do not have recycling receptacles readily available to pedestrians in high-traffic area. As a result, many recyclable materials either end up in refuse receptacles and taken to landfills or as litter.

SUMMARY OF THE INVENTION

The present invention involves an enclosure for refuse and recyclable containers and corresponding method of implementing the same that provides refuse and recycling receptacles in high-traffic pedestrian areas, keeping the streets, sidewalks, and other areas clean, diverts waste away from the landfills and back into the consumer stream of goods, and increases awareness of the importance of recycling.

A first aspect of the invention involves an enclosure for a refuse container and a recyclable container. The enclosure includes a frame; a front and a rear carried by the frame and including an advertising holder, a refuse opening, and a recyclable opening, the refuse opening receiving refuse therethrough for depositing the refuse in the enclosed refuse container, the recyclable opening receiving recyclables therethrough for depositing the recyclables in the enclosed recyclable container; a left side carried by the frame and including an advertising holder for holding advertising; a right side carried by the frame and including an advertising holder for holding advertising thereon; and a roof carried by the frame.

Another aspect of the invention involves a method of using an enclosure for a refuse container and a recyclable container. The method includes providing an enclosure for a refuse container and a recyclable container to an entity at no cost; providing advertising on the enclosure for a company for a fee; and providing the entity with a portion of the advertising fee.

Further objects and advantages will be apparent to those skilled in the art after a review of the drawings and the detailed description of the preferred embodiments set forth below.

DETAILED DESCRIPTION OF PREFERRED EMBODIMENTS

Figure 1:
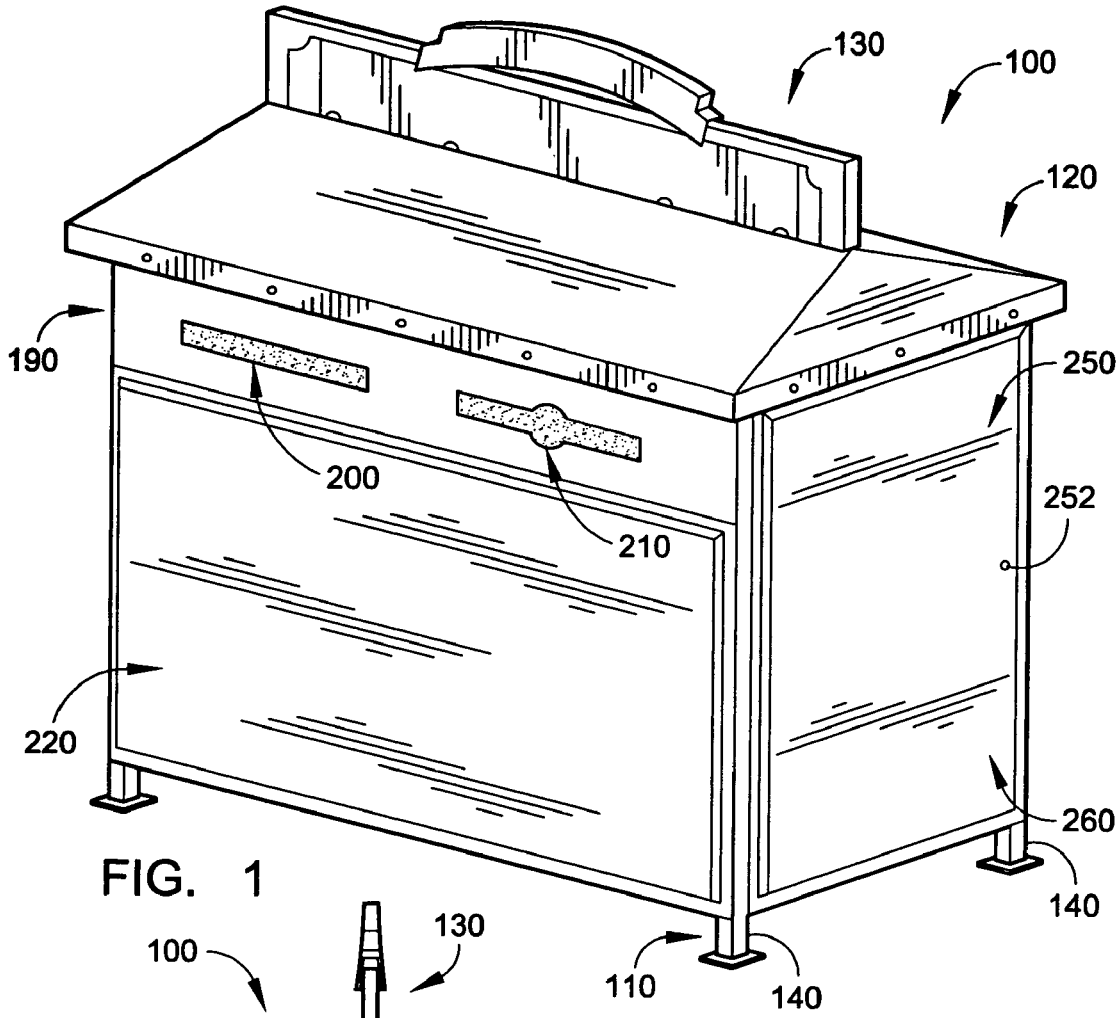
FIG. 1 is a front perspective view of an embodiment of an enclosure for refuse and recyclable containers.
Figure 2:
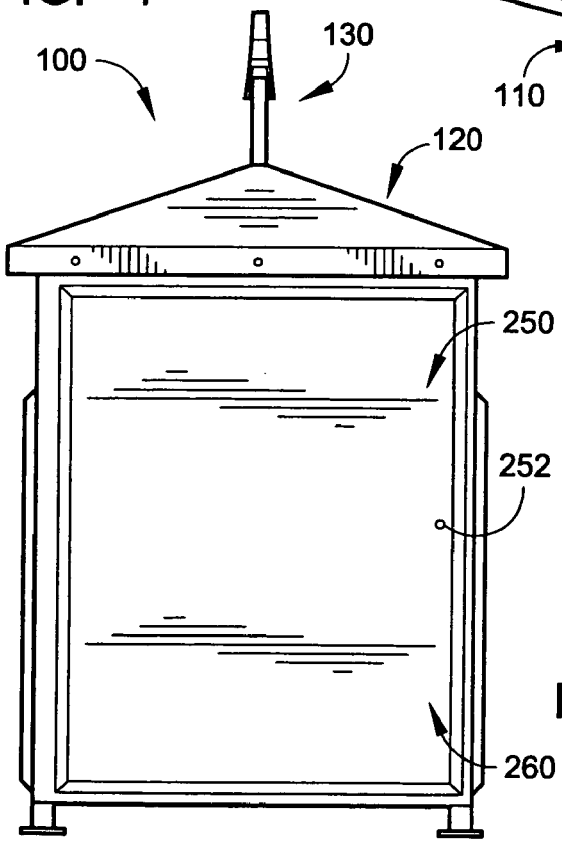
FIG. 2 is a right side-elevational view of the enclosure illustrated in FIG. 1.

With reference to FIGS. 1–6, an embodiment of an enclosure 100 for refuse and recyclable containers will now be described. Although the enclosure 100 will be described in conjunction with a refuse container 290 (FIG. 3) and a recyclable container 300, the enclosure may be used with either a refuse container 290 or recyclable container 300, or the enclosure 100 may be used with a refuse container 290 and more than one recyclable container 300. The enclosure 100 generally includes a frame 110, a roof or hood 120, and a sign assembly 130.

The frame 110 includes four legs 140, a pair of elongated longitudinal supports 160 that carry a metal grate 170, and three lateral supports 180 that extend between longitudinal supports 160, over the metal grate 170. The metal grate 170 includes multiple holes therein to allow fluid and air flow therethrough. The elongated longitudinal supports 160 are joined at opposite ends to the legs 140 as shown.

A front panel 190 is connected to a front of the frame 110. The front panel 190 includes an elongated, narrow rectangular refuse opening 200 and an elongated, narrow generally rectangular recyclable opening 210. In alternative embodiments, where the enclosure 100 includes a refuse container 290 or a recyclable container 300, or the enclosure 100 includes a refuse container 290 and more than one recyclable container 300, other numbers of openings may exist in the enclosure 100. The recyclable opening 210 includes a circular portion near its center to accommodate the diameters of cans, bottles, and the like. Recyclable items made of glass, plastic, aluminum, and paper are dropped into the enclosure 100 through the recyclable opening 210. Above and/or below the openings 200, 210, instructions are provided for disposing items. In alternative embodiments, the openings 200, 210 may have alternative configurations. The front panel 190 includes an enlarged rectangular advertising section 220 where advertising is preferably located. The advertising section 220 includes a frame with a clear plexiglass window that the advertising is disposed behind to view the advertising through.

A rear panel 230, which is similar to the front panel 190, is connected to a rear of the frame 110. Because the rear panel 230 is similar in construction to the front panel 190, it will not be described in further detail.

A first side panel or door 250 is hingeably connected to a leg 140 to form a recyclable access door 250. A key locking mechanism 252 is provided on the first side panel 250 and on the opposite leg (from the hinged leg 140) to lock the recyclable access door 250. The first side panel 250 includes a rectangular advertising section 260 where advertising is preferably located. The advertising section 260 is similar in construction to the advertising section 220.

A second side panel or door 270, which is similar to the recyclable access door 250, is located on the opposite side of the enclosure 100 from the recyclable access door 250 and forms a refuse access door 270. Because the refuse access door 270 is similar in construction to the recyclable access door 250, it will not be described in further detail.

Figure 3:
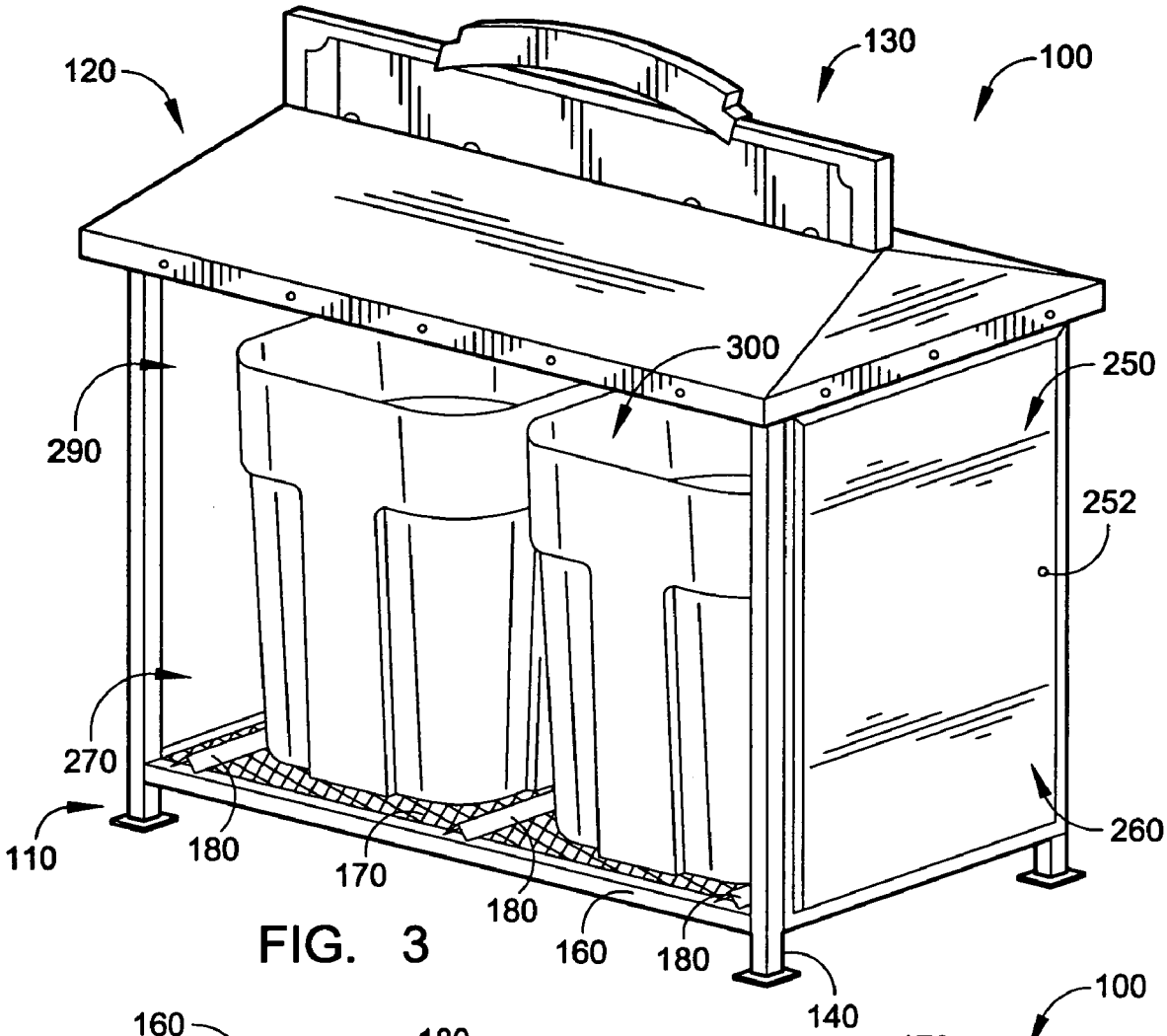
FIG. 3 is a front perspective view of the enclosure illustrated in FIG. 1 with a front panel removed to show the refuse and recyclable containers therein.
Figure 4:
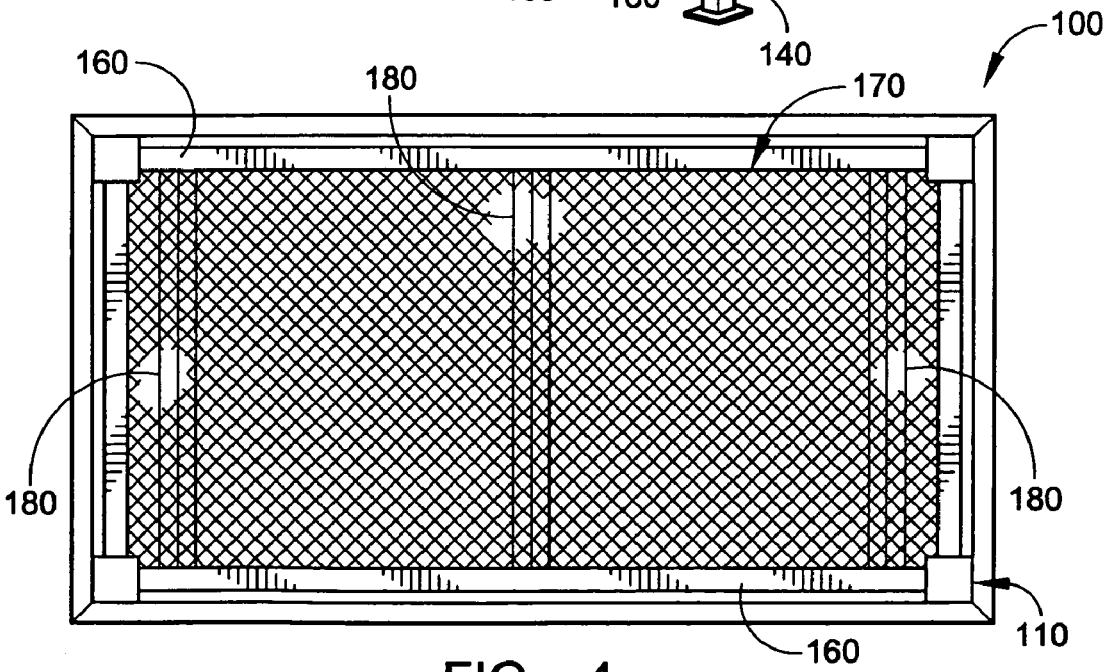
FIG. 4 is a bottom plan view of the enclosure illustrated in FIG. 1.
Figure 5:
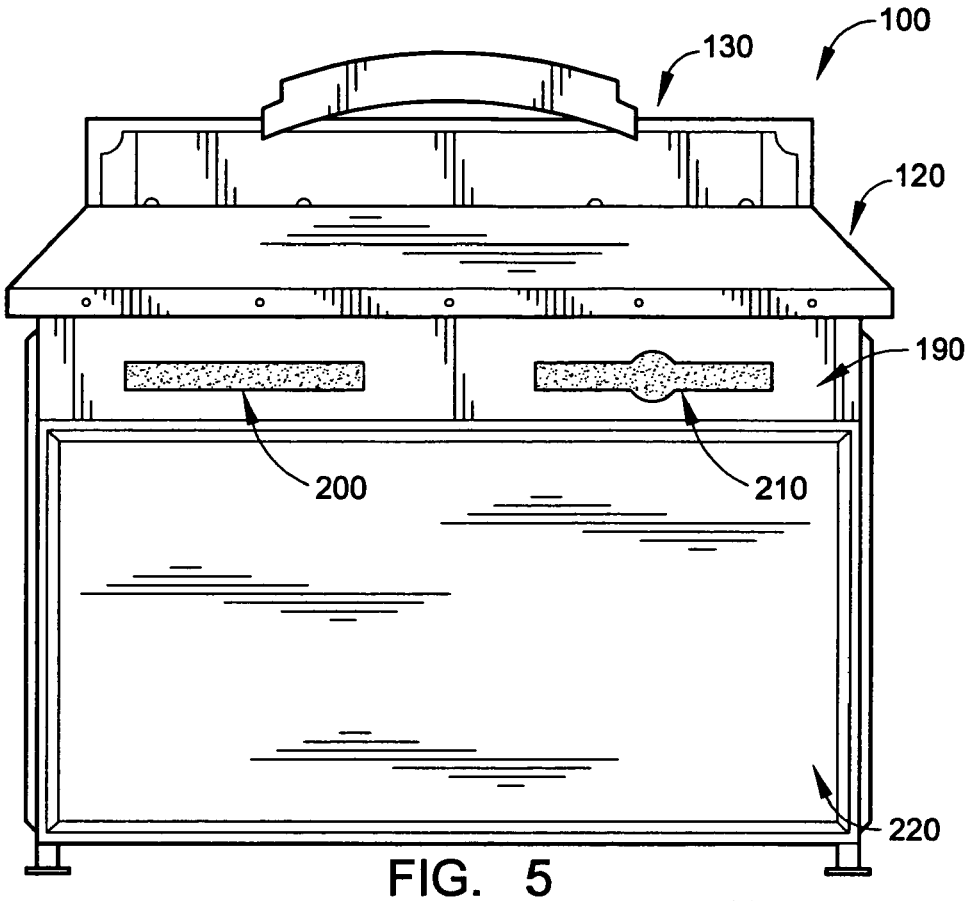
FIG. 5 is a front elevational view of the enclosure illustrated in FIG. 1.
Figure 6:
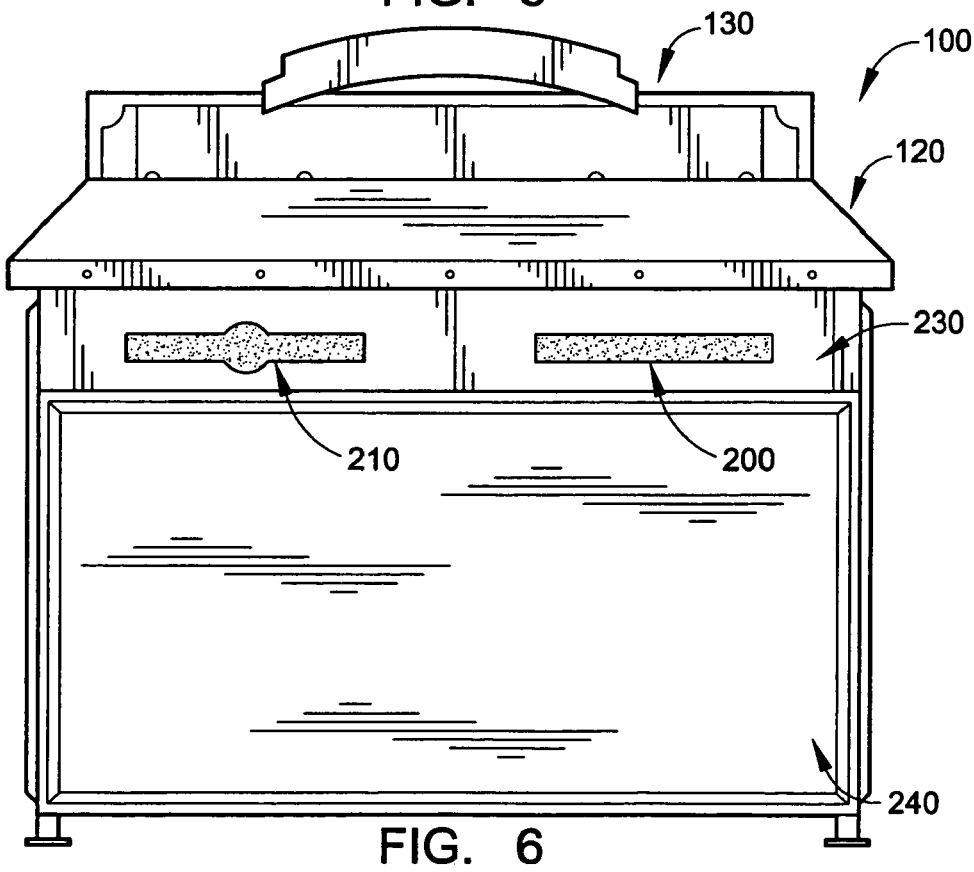
FIG. 6 is a rear elevational view of the enclosure illustrated in FIG. 1.

As shown in FIG. 3, the enclosure 100 is a two-chamber enclosure 100 in that the enclosure includes a refuse container 290 to receive trash and a recyclable container 300 to receive recyclable items. As described above, in alternative embodiments, the enclosure 100 may have alternative numbers of chambers/containers (e.g., 1, 3, 4, etc.). The refuse container 290 is located adjacent to and below the refuse opening 200 and adjacent to the first side panel or refuse access door 270. Similarly, as shown in FIG. 3, a recyclable container 300 is located adjacent to and below the recyclable opening 210 and adjacent to the second side panel or recyclable access door 250.

The roof 120 is connected to the top of the frame 110 and the sign assembly 130 is connected to the top of the roof 120. The sign assembly 130 advertises the area that the enclosure 100 is in or near and preferably includes artwork targeted towards the area. As used herein, "area" refers to the city, town, village, district, municipality, stadium, ballpark, park, monument, public transit system or other area that the enclosure is in or near and "entity" refers to the government or owner of the "area". Other portions of the enclosure 100 may also include artwork targeted towards the particular area. Because the sign assembly 130 and artwork are targeted towards the particular area, the sign assembly 130 and artwork are preferably distinct for each area. However, in an alternative embodiment, the enclosure 100 may be the same or generic for different areas. Although the sign assembly 130 is shown as an elongated, narrow panel, in alternative embodiments, the sign assembly 130 may have different constructions and configurations, some of which may be targeted towards the particular area that the enclosure 100 is used for. The enclosure 100, especially the sign assembly 130, is preferably aesthetically designed to enhance the surrounding environment, compared to traditional trash bins. The sign assembly 130 will provide community branding by advertising the area name where the enclosure is located.

On one or more portions of the roof 120 (e.g., on the portion(s) of the roof 120 adjacent the front panel 190, rear panel 230), the roof 120 preferably includes a map and/or directory of the business district that the enclosure 100 is in or adjacent to. The map may include details of the streets within walking distance and details on points of interests (e.g., pharmacy, gas station, convenience stores, other local stores, etc.). In an embodiment of the enclosure 100 where the enclosure is not located in a commercial setting (e.g., a local, state, or federal park), the map and/or directory on the roof 120 may include non-commercial location information (e.g., locations of points of interest in park). In an alternative embodiment, the roof 120 may not include a map and/or directory.

The outer structure of the enclosure 100 is generally made out of a powder-coated galvanized steel, to prevent rust and corrosion, and all of the other components are preferable made of rust and corrosion resistant materials. In alternative embodiments, the enclosure 100 and/or the components of the enclosure 100 may be made of other materials, such as, but not limited to, stainless steel.

Figure 7:
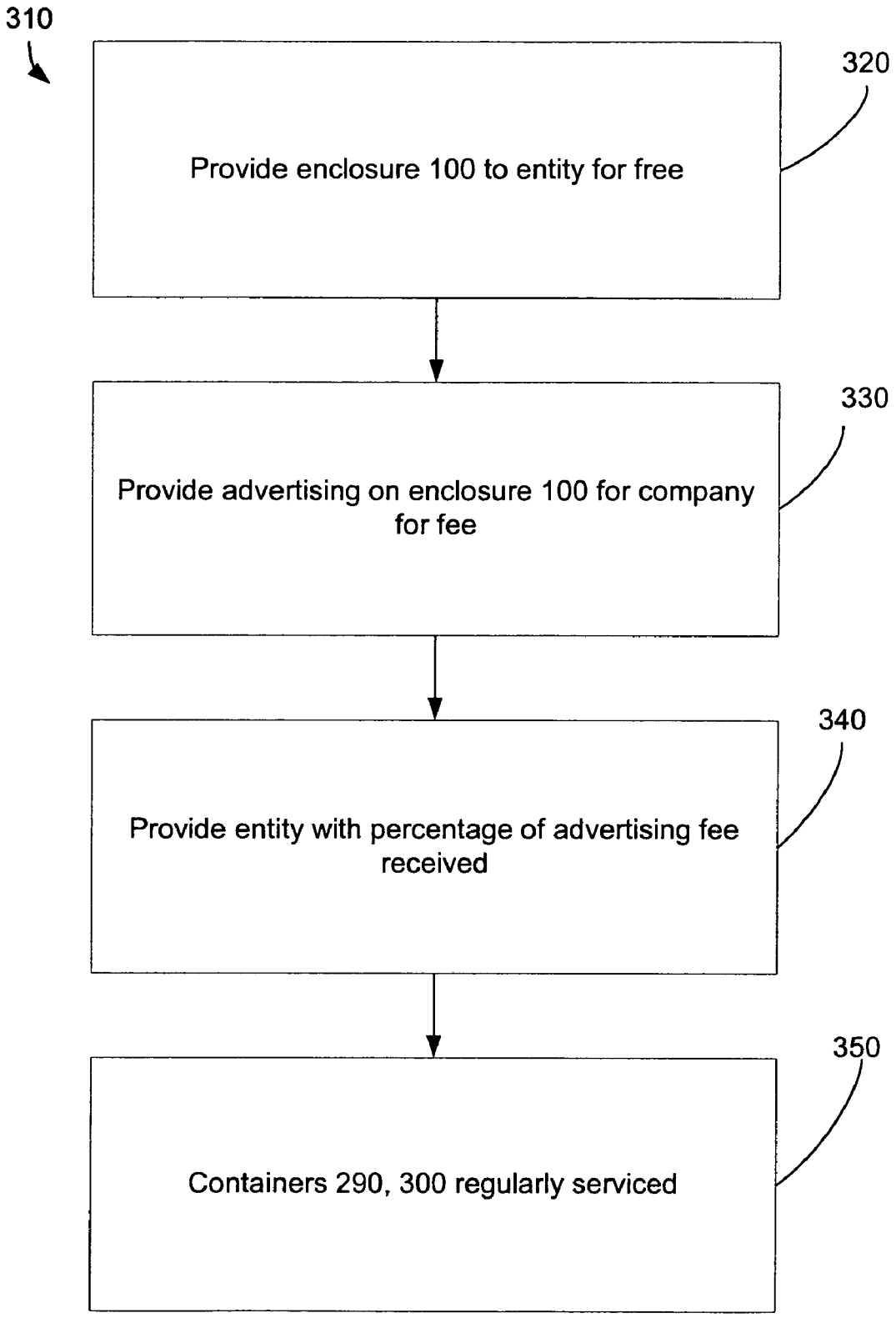
FIG. 7 is a flow chart of an exemplary method involving the enclosure illustrated in FIGS. 1–6.

With reference to FIG. 7, an exemplary method 310 involving the enclosure 100 will now be described. The method 310 will be described in conjunction with a single enclosure for simplicity; however, the present method 310 pertains to one or more enclosures 100. At step 320, the enclosure 100 is provided at no cost to an entity (e.g., municipality). In this step 320 (or an additional step), the enclosure 100 is installed at a desired location in the area, preferably in a high-traffic area such as at a busy street corner, at a downtown location, near the beach, and/or at a tourist area to facilitate recycling and waste disposal in public places. An existing refuse receptacle (or multiple existing refuse receptacles in an area) may be replaced with the enclosure 100 at the prior location (or near the area) of the refuse receptacle(s). The installation may be performed by the company providing the enclosure 100, a third party, or the entity responsible for refuse and recyclable collection. In this embodiment, where the enclosure 100 is provided to the entity at no cost, the company providing the enclosure 100 preferably retains ownership of the enclosure 100 and is responsible for maintenance on the enclosure 100. In an alternative embodiment, the enclosure 100 may be provided to the entity for a fee, the fee being below, at, or above the production cost of the enclosure 100. In this embodiment, the entity would own the enclosure 100 and would be responsible for maintaining it.

At step 330, the company providing the enclosure 100 or a third party provides advertising on the enclosure 100 for a fee by selling advertising space on the enclosure 100 to companies wanting to advertise. For example, a company wanting to advertise may buy advertising space on one or more of the advertising sections on the front panel 190, the rear panel 230, the first side panel 250, and the second side panel 270. The price of advertising preferably varies, depending on which panel(s) 190, 230, 250, 270 advertising is purchased on. For example, advertising on the side panels 250, 270 may cost less than advertising on the front panel 190 and the rear panel 230. Further, the price of advertising may further vary depending on whether the advertising is on the front panel 190, the rear panel 230, the first side panel 250, or the second side panel 270. The company providing the enclosure 100 or a third party applies the advertising to the panel(s) 190, 230, 250, 270 by inserting the advertising in the frame under the plexiglass. Preferably, the unused advertising faces of the enclosure 100 are used by the entity to promote environmental campaigns (e.g., "Keep (insert area) Beautiful") and other environmentally friendly messages.

Next, in step 340, the company providing the enclosure 100 provides the entity with a percentage of the advertising revenue (or total advertising revenue for all enclosures 100 in the area) collected. This percentage of advertising revenue collected by the entity may be used to alleviate the cost burden of recycling to the entity. This percentage may be a portion of total advertising revenue from the enclosure(s) 100 in the area or some other calculation based at least in part on advertising revenue from the enclosure(s) 100 in the area. The amount sent to the entity is performed on a periodic basis (e.g., monthly, quarterly, semi-annually, annually). This percentage of the advertising fee provided to the entity may be earmarked for a special purpose (e.g., recycling, environment, parks and recreation, reinvestment in the community, etc.). In an alternative embodiment, step 340 may not exist in the method 310 so that the entity does not receive any of the advertising revenue.

In step 350, a waste management and pick-up crew of the entity or a hired third party regularly services the containers 290, 300 by regular pick-up of the refuse/recyclables in the containers 290, 300. The waste management and pick-up crew carries a key (or keys) to the lock mechanisms 252 on the doors 250, 270. The doors 250, 270 are unlocked and opened. Then, the containers 290, 300 are removed and dumped into the appropriate bins in the refuse/recyclable collection vehicle(s). The containers 290, 300 are reinserted into the enclosure 100, and the doors 250, 270 are shut and locked. Refuse may then be taken to a landfill, and the recyclables may be taken to a recycling center. Preferably, the entity will receive 100% of the revenue from the sale of recyclable materials. In an alternative embodiment, the company providing the enclosures or a third party may receive a percentage of the revenue from the sale of recyclable materials.

Advantages of the enclosure 100 and method 310 include keeping the streets, sidewalks, and other areas clean, diverting waste away from the landfills and back into the consumer stream of goods, and increasing awareness of the importance of recycling. Currently, all materials collected in current public trash receptacles are transferred to waste grounds and buried in landfills. The enclosure 100 and method 310 cause recyclable materials to be separated from general waste, helping to reduce landfills and clean the environment. The entities (e.g., municipalities) do not incur any additional cost with the enclosure 100 and method 310 because the entity continues with pick up and disposal of refuse/recyclables. In the event the entity has to start a recycling program in the present method 310, the additional revenue streams the entity obtains from the percentage of advertising revenue and the sale of recyclables offsets (and may exceed) the cost of such a recycling program. The enclosure 100 and method 210 provide an effective recycling program in urban areas and raises the environmental awareness of individuals. The enclosure 100 is aesthetically designed to enhance the surrounding environment, compared to traditional trash bins, and provides community branding for the area where the enclosures are located, at no cost to the entity. The enclosure 100 also provides a map and/or directory of the business district that the enclosure 100 is located in or near to assist pedestrians in navigating the area and locating points of interest in the area.

It will be readily apparent to those skilled in the art that still further changes and modifications in the actual concepts described herein can readily be made without departing from the spirit and scope of the invention as defined by the following claims.

What is claimed is:

1. An enclosure for a refuse container and a recyclable container, comprising:

a frame;

a front and a rear carried by the frame and including an advertising holder, a refuse opening, and a recyclable opening, the refuse opening receiving refuse therethrough for depositing the refuse in the enclosed refuse container, the recyclable opening receiving recyclables therethrough for depositing the recyclables in the enclosed recyclable container;

a left side carried by the frame and including an advertising holder for holding advertising;

a right side carried by the frame and including an advertising holder for holding advertising thereon;

a roof carried by the frame;

a single grate comprising latticed bars that form holes therebetween to allow fluid and air flow therethrough, the single grate carried by the frame for supporting both the refuse container and the recyclable container;

a central lateral support on the single grate for separating the refuse container from the recyclable container;

a first outer lateral support on the single grate adjacent to the right side;

a second outer lateral support on the single grate adjacent to the left side, wherein the first outer lateral support and the central lateral support define a region on the grate that the recyclable container is supported on and the second outer lateral support and the central lateral support defining a region on the grate that the refuse container is supported on.

2. The enclosure of claim 1, further including a sign assembly carried by the roof, the sign assembly indicating the area in which the enclosure is located.

3. The enclosure of claim 1, wherein the refuse opening and the recyclable opening have different configurations.

4. The enclosure of claim 1, wherein the enclosure has a substantially rectangular box-like configuration.

5. The enclosure of claim 1, wherein the left side and the right side include doors pivotally connected to the frame for accessing the refuse container and the recyclable container.

6. The enclosure of claim 5, wherein the doors include key lock mechanisms for locking and unlocking the doors.

7. The enclosure of claim 1, wherein the frame includes four legs, a pair of elongated longitudinal supports that carry the single grate, and the three lateral supports extending between the longitudinal supports, over the single grate.

8. The enclosure of claim 1, wherein the recyclable opening includes an elongated, narrow rectangular opening with a circular central portion.

9. The enclosure of claim 1, further including instructions adjacent the openings providing instructions for disposing items.

10. The enclosure of claim 1, wherein the right side and the left side include doors therein for accessing the recyclable container and the refuse container, and the doors include vertically centered key lock mechanisms adjacent the rear for locking and unlocking the doors.

11. The enclosure of claim 1, wherein the right side includes a door for solely accessing one of the recyclable container and the refuse container, and the left side includes a door for solely accessing the other container.

12. The enclosure of claim 1, wherein the roof includes at least one of a map of the area in which the enclosure is located, a directory of a business district of the area in which the enclosure is located, and directions for the area in which the enclosure is located.

13. The enclosure of claim 1, wherein the roof includes an angled front portion, an angled rear portion, an angled left portion and an angled right portion, the angled front portion and the angled rear portion are symmetric, and the angled left portion and the angled right portion are symmetric.

14. An enclosure for a refuse container and a recyclable container, comprising:

a frame including four legs and a pair of elongated longitudinal supports;

a front and a rear carried by the frame and including an advertising holder, a refuse opening, and a recyclable opening, the refuse opening receiving refuse therethrough for depositing the refuse in the enclosed refuse container, the recyclable opening receiving recyclables therethrough for depositing the recyclables in the enclosed recyclable container;

a left side carried by the frame and including an advertising holder for holding advertising;

a right side carried by the frame and including an advertising holder for holding advertising thereon;

a roof carried by the frame, the roof including an angled front portion, an angled rear portion, an angled left portion and an angled right portion, the angled front portion and the angled rear portion are symmetric, and the angled left portion and the angled right portion are symmetric;

a single grate comprising latticed bars that form holes therebetween to allow fluid and air flow therethrough, the single grate carried by the longitudinal supports for supporting both the refuse container and the recyclable container;

a central lateral support extending between the longitudinal supports and located on the single grate for separating the refuse container from the recyclable container;

a first outer lateral support extending between the longitudinal supports and located on the single grate adjacent to the right side;

a second outer lateral support extending between the longitudinal supports and located on the single grate adjacent to the left side, wherein the first outer lateral support and the central lateral support define a region on the grate that the recyclable container is supported on and the second outer lateral support and the central lateral support defining a region on the grate that the refuse container is supported on.

15. The enclosure of claim 14, wherein the right side includes a door for solely accessing one of the recyclable container and the refuse container, and the left side includes a door for solely accessing the other container.

16. The enclosure of claim 15, wherein the recyclable opening includes an elongated, narrow rectangular opening with a circular central portion.

17. The enclosure of claim 16, further including instructions adjacent the openings providing instructions for disposing items.

* * * * *